US006581562B2

(12) United States Patent
Goebel et al.

(10) Patent No.: US 6,581,562 B2
(45) Date of Patent: Jun. 24, 2003

(54) OPEN CENTER RECOIL STARTER

(75) Inventors: Nicholas R. Goebel, New Holstein, WI (US); Thomas A. Immel, Malone, WI (US)

(73) Assignee: Tecumseh Products Company, Tecumseh, MI (US)

( * ) Notice: Subject to any disclaimer, the term of this patent is extended or adjusted under 35 U.S.C. 154(b) by 22 days.

(21) Appl. No.: 09/883,563

(22) Filed: Jun. 18, 2001

(65) Prior Publication Data

US 2002/0189568 A1 Dec. 19, 2002

(51) Int. Cl.[7] ..... F02N 3/00
(52) U.S. Cl. ..... 123/185.3; 123/41.63
(58) Field of Search ..... 123/185.3, 185.2, 123/185.4, 41.63, 41.64, 41.65

(56) References Cited

U.S. PATENT DOCUMENTS

| | | | | | |
|---|---|---|---|---|---|
| 2,604,882 | A | | 7/1952 | Schnacke | 123/185 |
| 2,848,987 | A | | 8/1958 | Morden | 123/179 |
| 2,942,599 | A | * | 6/1960 | Irgens | 123/185.4 |
| 3,098,331 | A | * | 7/1963 | Fox | 451/415 |
| 3,366,099 | A | | 1/1968 | Kaufman | 123/185 |
| 3,570,464 | A | | 3/1971 | Morabit et al. | 123/185 |
| 3,754,543 | A | * | 8/1973 | Harkness | 123/185.3 |
| 3,827,307 | A | * | 8/1974 | Couchman, Jr. | 74/6 |
| 4,003,190 | A | * | 1/1977 | Braun et al. | 56/10.5 |
| 4,068,644 | A | * | 1/1978 | Newport | 123/185.3 |
| 4,261,437 | A | * | 4/1981 | Zavatkay et al. | 185/45 |
| 4,658,775 | A | * | 4/1987 | Greenwood et al. | 123/185.3 |
| 5,063,812 | A | * | 11/1991 | Mercier | 74/575 |
| 5,477,588 | A | * | 12/1995 | Iida et al. | 15/405 |

* cited by examiner

*Primary Examiner*—Mahmoud Gimie
(74) *Attorney, Agent, or Firm*—Baker & Daniels

(57) ABSTRACT

An open center recoil starter in a small internal combustion engine having a blower housing, a flywheel, and a crankshaft. The open center recoil starter generally includes an annular cover mounted to the blower housing and defining an airway into the blower housing and the engine. The open center recoil starter also includes an annular mechanism for engaging the flywheel, thereby rotating both the flywheel and the crankshaft to start the engine.

20 Claims, 6 Drawing Sheets

OPEN CENTER RECOIL STARTER

BACKGROUND OF THE INVENTION

1. Field of Invention

The present invention relates to small internal combustion engines such as those used with lawnmowers, lawn tractors, and other lawn and garden implements. In particular, the present invention relates to a new recoil starter for such engines.

2. Description of the Related Art

Typically, implements with small internal combustion engines include a manually-operable recoil starter for engine starting. The recoil starter includes a handle and rope pull assembly which is manually pulled by an operator to rotate the flywheel and crankshaft in order to begin reciprocation of the piston as well as actuation of the ignition assembly to start the engine.

The pulleys of prior recoil starters are usually restrictive in the center to airflow, allowing only an annular air opening around the outer recoil region. The pulley construction necessitates that air entering the engine must be directed around the pulley, thus the pulley restricts airflow into the engine. To compensate for the restricted airflow, prior methods, such as elevating the pulley assembly to create a small area for air to enter beneath the pulley, were implemented. However, the engines which incorporate these methods may still experience restricted airflow since a maximum amount of air is not drawn into the engine through the small area.

What is needed is a recoil starter having a construction which allows a maximum amount of air to easily enter the engine for improved engine cooling.

SUMMARY OF THE INVENTION

A centerless recoil starter is provided which is used with a small internal combustion engine having a blower housing, a flywheel, and a crankshaft. The centerless recoil starter generally includes an annular cover mounted to the blower housing and defining an airway into the blower housing and the engine and also includes an annular starter mechanism for engaging the flywheel, thereby rotating both the flywheel and the crankshaft to start the engine.

The annular starter mechanism for engaging the flywheel includes an annular ring within a track around the airway having engagement elements, such as pulley dogs, therein to engage posts on the flywheel. The pulley dogs have a retracted position during normal engine operation and an extended position for engaging the posts during engine starting. Also included is a spring which retracts the rope and pulley thus causing the pulley dogs to rotate back to their retracted position.

An advantage of the inventive recoil starter is that airflow to the engine is unrestricted. With the recoil starter having a substantially open center, air is freely able to enter the blower housing and the engine to provide less restrictive airflow to the engine.

The present invention provides an internal combustion engine, including a crankcase having a crankshaft rotatably disposed therein, a flywheel mounted to the crankshaft externally of the crankcase, a blower housing attached to the crankcase and having an opening disposed generally above the flywheel, and an annular recoil starter mechanism attached to the blower housing and disposed around the opening to define a center airway therethrough into the blower housing. The annular recoil starter mechanism selectively engages the flywheel to rotate the flywheel and the crankshaft to start the engine.

The present invention further provides an internal combustion engine, including a crankcase having a crankshaft rotatably disposed therein, a flywheel mounted to the crankshaft, a blower housing attached to the crankcase, and an annular recoil starter mechanism attached to the blower housing and disposed around an opening in the blower housing generally above the flywheel.

The present invention also provides an implement having a small internal combustion engine including a frame, an engine connected to the frame and having a crankshaft disposed therein, a flywheel mounted to the crankshaft, and an annular recoil starter mechanism attached to the housing and disposed around an opening in the housing generally above the flywheel.

BRIEF DESCRIPTION OF THE DRAWINGS

The above-mentioned and other features and advantages of this invention, and the manner of attaining them, will become more apparent and the invention itself will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION

Figure 1:
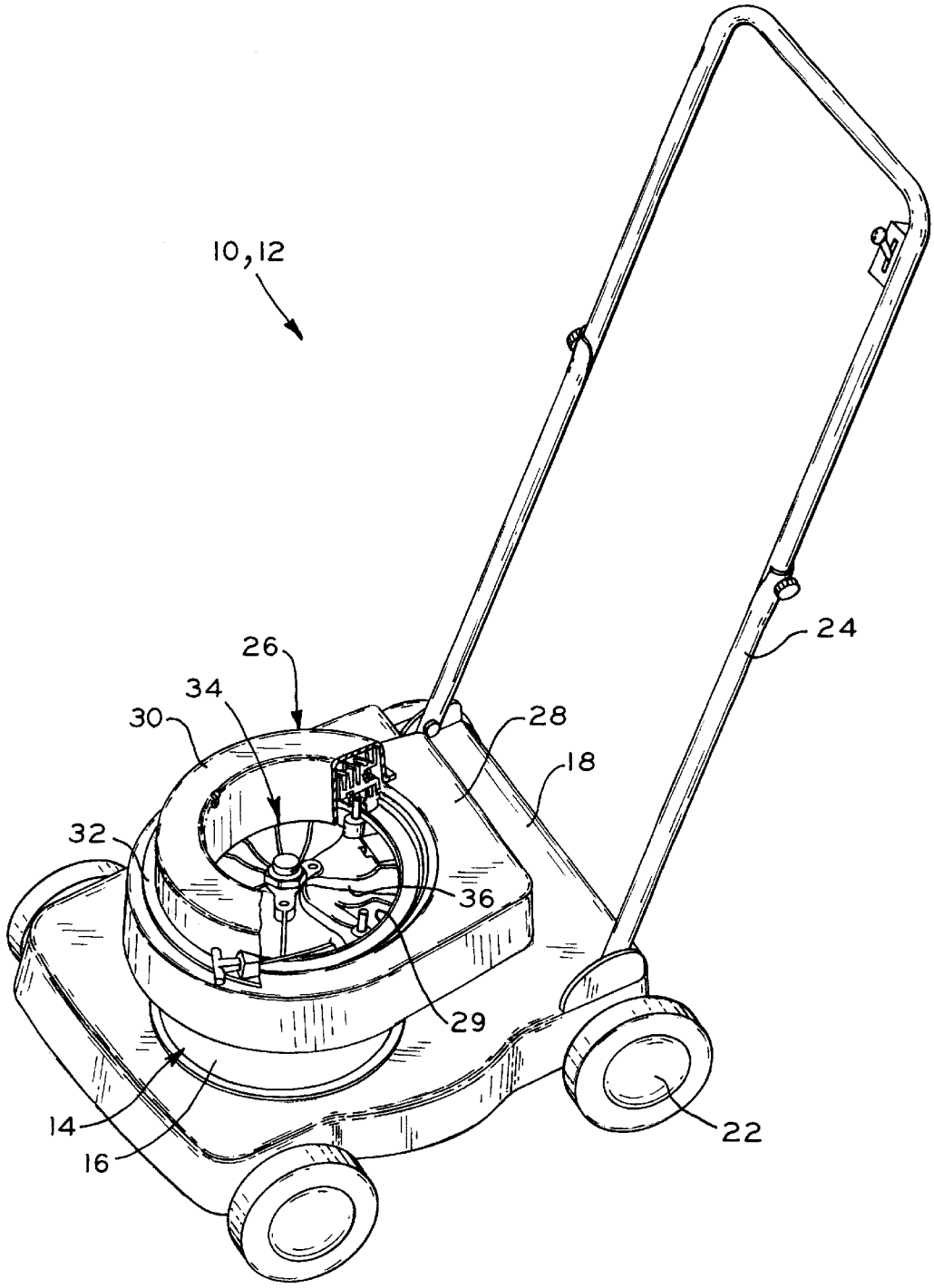
FIG. 1 is a perspective view of a lawnmower having a centerless recoil starter in accordance with the present invention, the recoil starter being shown partially cut away.

Referring first to FIG. 1, a centerless recoil starter is shown as part of implement 10, or more specifically, lawnmower 12. Lawnmower 12 includes engine 14 having crankcase 16, deck 18, and handle 24 attached to deck 18. Centerless recoil starter 26 is attached to blower housing 28 in such a manner that starter cover 30 is fixed to blower housing 28 by the connection of flange 32 to blower housing 28, thereby preventing rotation of starter cover 30. As part of starter 26, starter cover 30 surrounds the elements of starter 26 and includes open center area 34 through which air is able to easily enter engine 14. Flywheel 36 is affixed to crankshaft 38 in a known manner, by nut 40. Crankshaft 38 is rotatably disposed in crankcase 16, and is attached to a piston (not shown) by a connecting rod (not shown) in a known manner. Blower housing 28 includes opening 29 therein, disposed above flywheel 36, through which air may enter blower housing 28.

Figure 2:
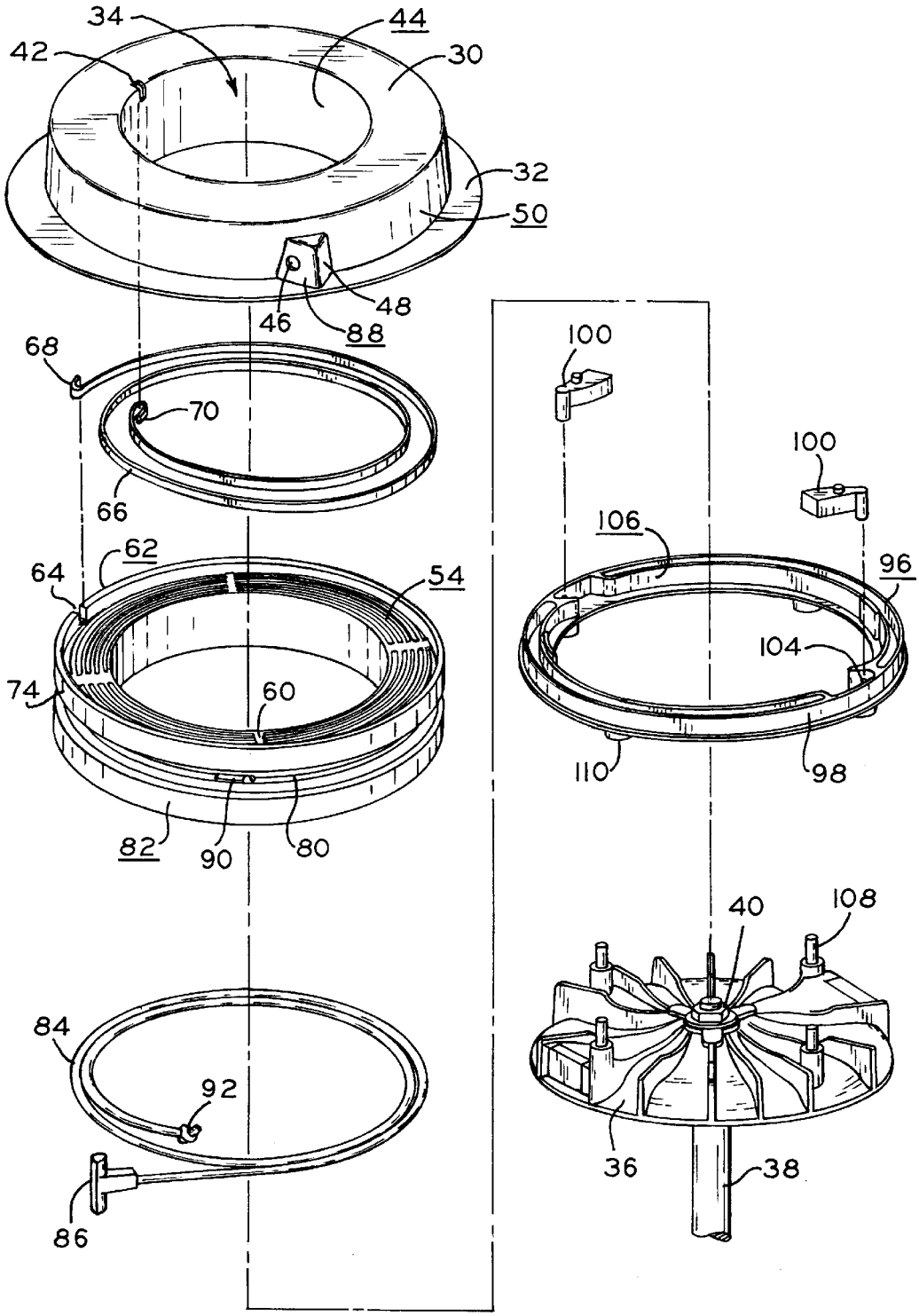
FIG. 2 is an exploded view of the recoil starter of FIG. 1, viewed from above.
Figure 2A:
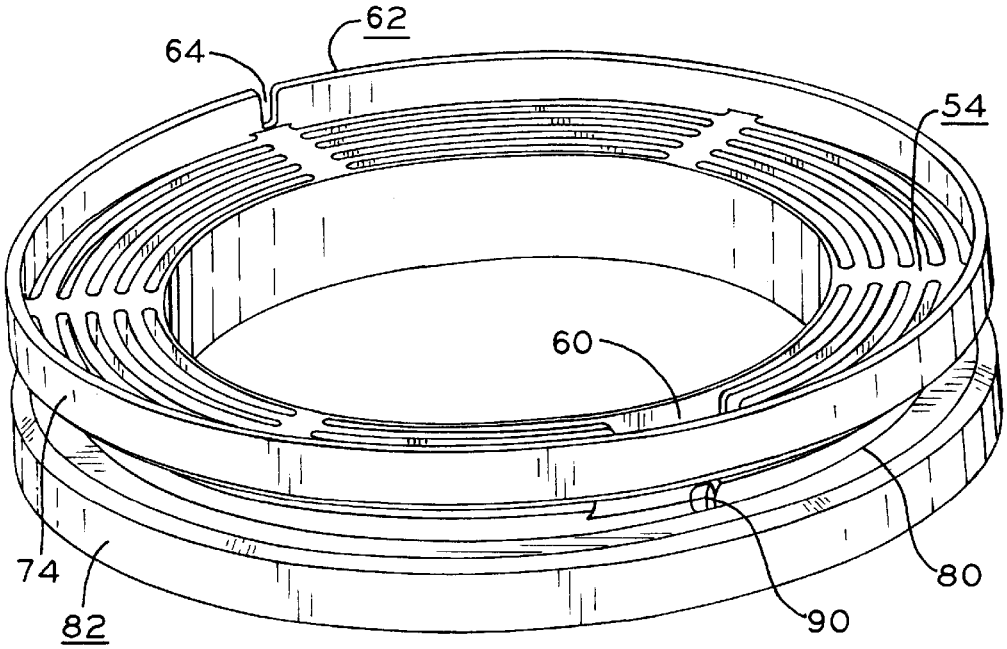
FIG. 2A is an enlarged view of the first annular ring of the recoil starter of FIG. 2.
Figure 3:
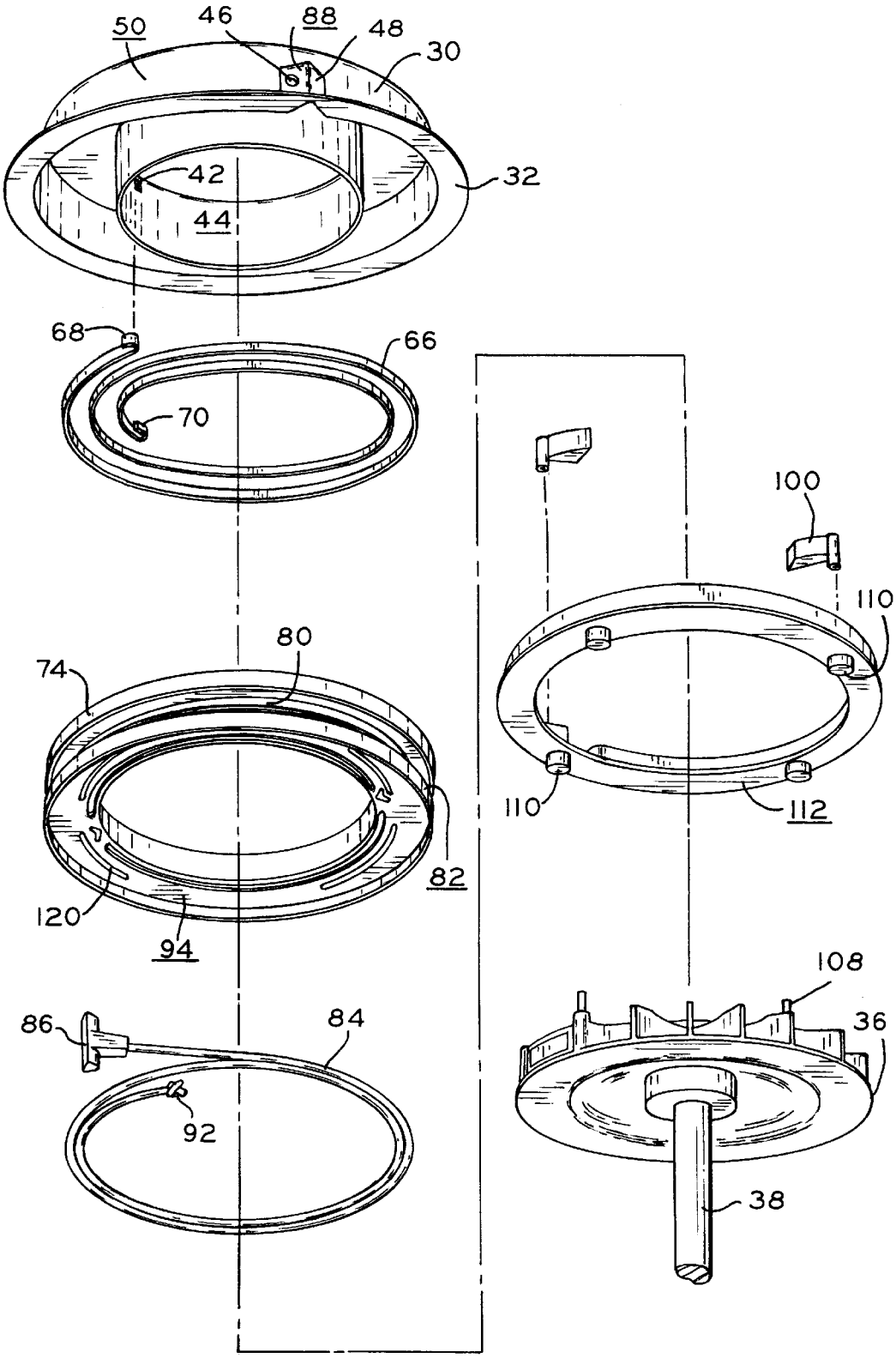
FIG. 3 is an exploded view of the recoil starter of FIG. 1, viewed from below.

With reference to FIGS. 2 and 3, starter cover 30 includes slot 42 within inner circumferential surface 44, and aperture 46 within protrusion 48 of outer circumferential surface 50. Additionally, inner circumferential surface 44 defines open center area 34. First annular ring 74 includes upper surface 54 and rim surface 62 having slot 64 therein, also shown in FIG. 2A. Coil spring 66, disposed between starter cover 30 and first annular ring 74 and resting on upper surface 54, has first end 68 received in slot 64 and second end 70 being in slot 42 of starter cover 30, thereby connecting starter cover 30 and first annular ring 74.

Referring again to FIGS. 2 and 3, annular pulley ring 74 further includes groove 80 in outer circumferential surface 82 thereof for containing pulley rope 84. Pulley rope 84 is wound around annular ring 74, in groove 80, multiple times and emerges through aperture 46 where pulley rope 84 terminates in handle 86 abutting flat surface 88 of protrusion 48. The opposite end of pulley rope 84 is inserted through hole 90 in annular ring 74. Pulley rope 84 terminates in knot 92 which is maintained in slot 60 to connect pulley rope 84 to first annular ring 74. Annular ring 74 further includes lower surface 94, which abuts upper surface 96 of second annular ring 98.

Figure 5:
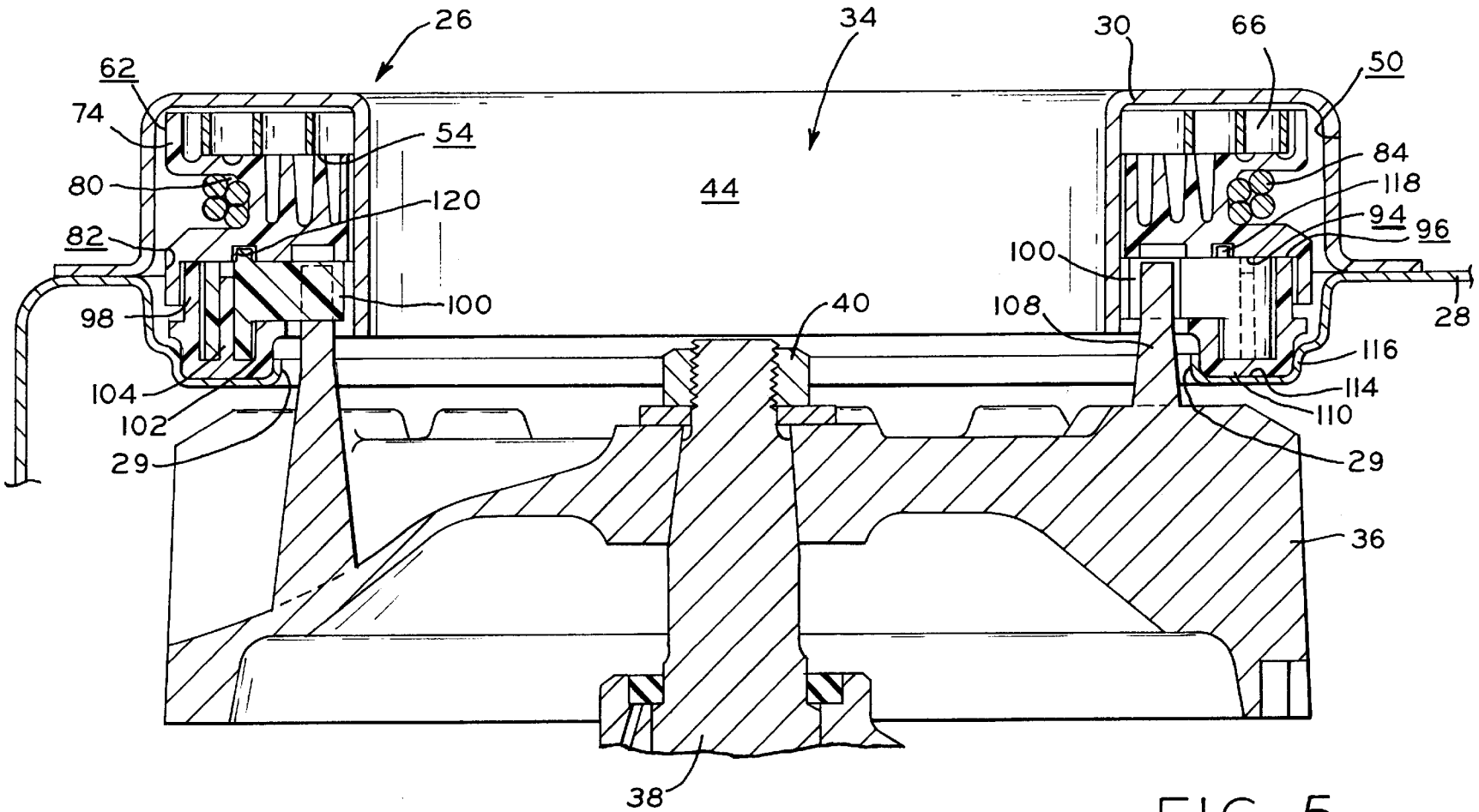
FIG. 5 is an enlarged sectional view through a diameter of the recoil starter of FIG. 4.

Second annular ring 98 retains engagement elements, such as pulley dogs 100, in a corresponding number of recesses 102 which form bearing surfaces for pulley dogs 100 and which have pivot pins 104 integrally formed therein. Pulley dogs 100 may pivot in a limited manner around pivot pins 104 (FIG. 5). Within inner circumference 106 of annular ring 98 are engagement members formed as flywheel posts 108, which are cast with flywheel 36. Although flywheel 36 is positioned beneath blower housing 28, flywheel posts 108 extend upwardly above blower housing 28 to engage pulley dogs 100.

Figure 4:
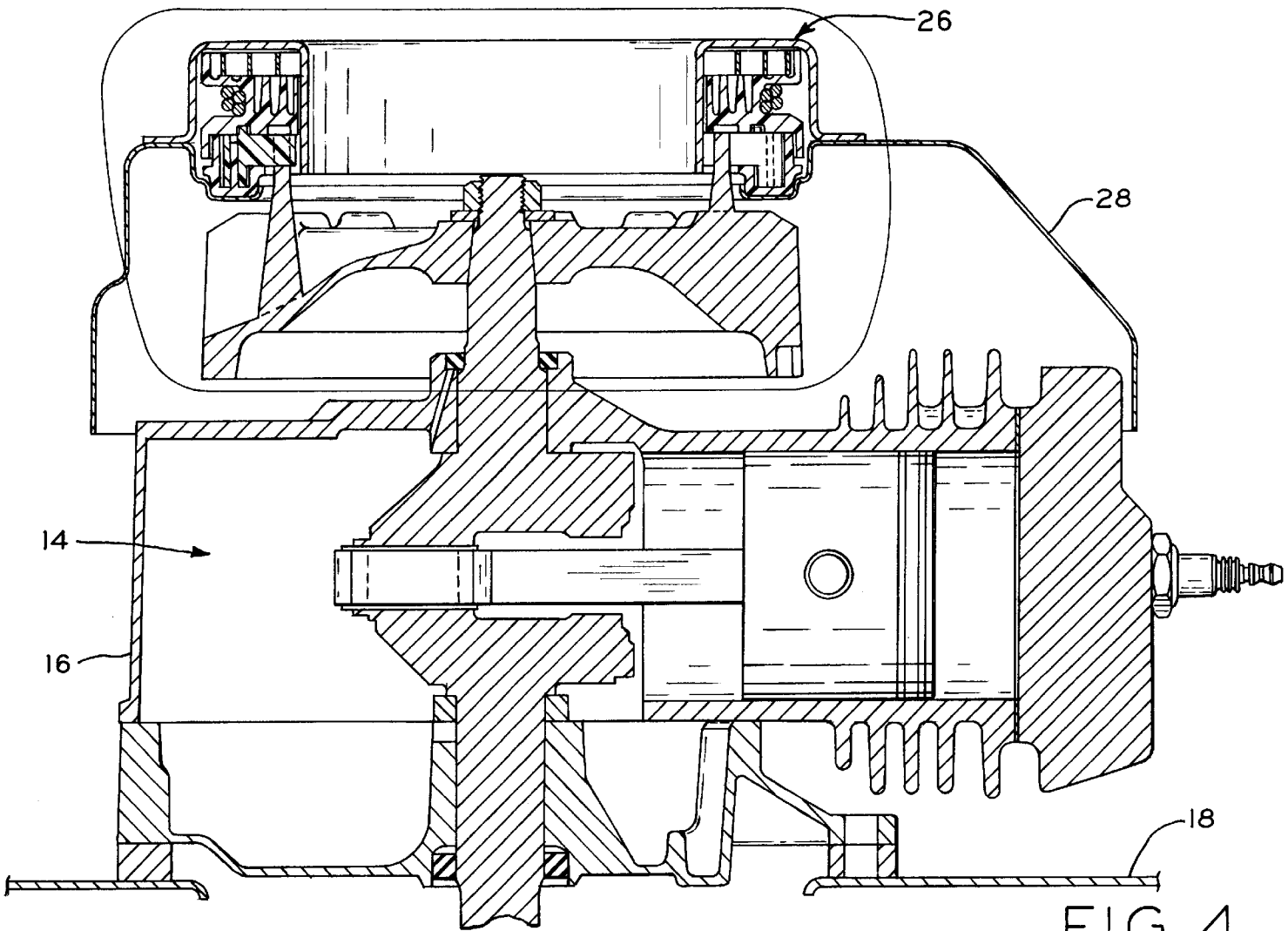
FIG. 4 is a sectional view through a diameter of the recoil starter of FIG. 1, the recoil starter shown attached to the blower housing of a lawnmower.

Referring now to FIGS. 4 and 5, a sectional view of starter 26, attached to blower housing 28, is shown. FIG. 5 shows an enlarged sectional view of recoil starter 26, circled in FIG. 4. Protruding feet 110 are formed in lower surface 112 of second annular ring 98 and are slidably disposed in shallow groove 114 of bottom track 116, thereby allowing annular ring 98 to rotate. Bottom track 116 is disposed within blower housing 28 and above flywheel 36. Bottom track 116 may be formed with blower housing 28 or constitute a separate part which is then attached to blower housing 28. Pulley dogs 100 pivot around pins 104, to engage flywheel posts 108. Pulley dogs 100 also include projections 118 that are received in arcuate grooves 120 on lower surface 94 of annular ring 74. Arcuate grooves 120 are not concentric with the axis of crankshaft 38 and force pulley dogs 100 to swing inward during recoil starter 26 operation.

In operation, an operator grasps pulley rope handle 86 and pulls pulley rope 84. This action causes annular rings 74 and 98 to rapidly rotate and to cause pulley dogs 100 to swing inwardly, due to the cam action of arcuate grooves 120 and causing projections 118 to move inward, to a maximum projection distance where pulley dogs 100 engage flywheel posts 108 to rotate flywheel 36 for engine starting. Concurrently, coil spring 66 contracts due to its attachment to stationary starter cover 30 and rotating annular ring 74; when annular ring 74 rotates, first end 68 of coil spring 66 also rotates while second end 70 remains stationary, thereby contracting coil spring 66.

After rope 84 is pulled to its furthest extent and the engine is started, release of tension on rope 84 by the operator allows coil spring 66 to unwind, thereby causing annular rings 74 and 98 to rotate in an opposite direction and to return to pre-starting positions. After the engine starts, flywheel 36 rotates much faster than annular rings 74 and 98. This difference in rotational speeds causes flywheel posts 108 to contact the back of pulley dogs 100, thereby causing pulley dogs 100 to swing back outward to a pre-starting position in which pulley dogs 100 are disposed radially outward of flywheel post 108. Furthermore, arcuate grooves 120 force pulley dogs 100 into a retracted position when ring 74 rotates in an opposite direction due to the camming action of grooves 120 causing projections 118 to move outwardly. Engine operation then continues in a known manner.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An internal combustion engine, comprising:

a crankcase having a crankshaft rotatably disposed therein;

a flywheel connected to said crankshaft externally of said crankcase;

a blower housing attached to said crankcase, said blower housing having an opening disposed generally above said flywheel; and an annular recoil starter mechanism attached to one of said blower housing and crankcase and disposed around said opening to define a center airway therethrough into said blower housing, said annular recoil starter mechanism selectively engaging said flywheel to rotate said flywheel and said crankshaft to start said engine.

2. The internal combustion engine of claim 1, wherein said flywheel includes a plurality of fins for drawing and directing air through said airway along an axis coincident with said crankshaft.

3. The internal combustion engine of claim 1, wherein said blower housing further includes an annular track disposed around said opening, and said annular recoil starter mechanism further comprises:

an annular ring member slidably disposed within said track; and a cover fixed to said blower housing, said cover enclosing said annular ring member.

4. The internal combustion engine of claim 3, wherein said flywheel includes at least one engagement member thereon, and said annular recoil starter mechanism further comprises:

at least one engagement element carried by said annular ring member, said at least one engagement element having a retracted position wherein said at least one engagement element does not engage said at least one flywheel engagement member, and an extended position wherein said at least one engagement element engages said at least one flywheel engagement member.

5. The internal combustion engine of claim 4, wherein said annular recoil starter mechanism further comprises a spring biasing said annular ring member in a pre-starting position wherein said at least one engagement element is in its said retracted position.

6. The internal combustion engine of claim 5, wherein said spring is connected between said annular ring member and said cover.

7. An internal combustion engine, comprising:

a crankcase having a crankshaft rotatably disposed therein;

a flywheel connected to said crankshaft;

a blower housing attached to said crankcase, said blower housing including an opening disposed generally above said flywheel; and an open center, annular recoil starter mechanism attached to said blower housing and disposed around said opening.

8. The internal combustion engine of claim 7, wherein said opening defines a center airway into said blower housing.

9. The internal combustion engine of claim 8, wherein said flywheel includes a plurality of fins for drawing and directing air through said airway.

10. The internal combustion engine of claim 7, wherein said annular recoil starter mechanism further comprises:

an annular track disposed around said opening in said blower housing;

an annular ring member slidably disposed within said annular track; and a cover fixed to said blower housing, said cover enclosing said annular ring member.

11. The internal combustion engine of claim 10, wherein said flywheel includes at least one engagement member thereon, and said annular recoil starter mechanism further comprises:

at least one engagement element carried by said annular ring member, said at least one engagement element having a retracted position wherein said at least one engagement element does not engage said at least one flywheel engagement member, and an extended position wherein said at least one engagement element engages said at least one flywheel engagement member.

12. The internal combustion engine of claim 11, wherein said annular recoil starter mechanism further comprises a spring biasing said annular ring member in a pre-starting position such that said at least one engagement element is in its said retracted position.

13. The internal combustion engine of claim 12, wherein said spring is connected between said annular ring member and said cover.

14. An implement comprising:

a frame;

an engine connected to said frame and having a crankshaft disposed therein;

a flywheel mounted to said crankshaft;

a housing attached to said engine, said housing including an opening disposed generally above said flywheel; and an open center, annular recoil starter mechanism attached to said housing and disposed around said opening in said housing.

15. The implement of claim 14, wherein said opening defines a center airway into said housing.

16. The implement of claim 15, wherein said flywheel includes a plurality of fins for drawing and directing air through said center airway along an axis coincident with said crankshaft.

17. The implement of claim 14, wherein said annular recoil starter mechanism further comprises:

an annular track disposed around said opening in said housing;

an annular ring member slidably disposed within said track; and a cover attached to said housing, said cover enclosing said annular ring member.

18. The implement of claim 14, wherein said flywheel includes at least one engagement member thereon, and said annular recoil starter mechanism comprises:

at least one engagement element, said at least one engagement element having a retracted position wherein said at least one engagement element does not engage said at least one flywheel engagement member, and an extended position wherein said at least one engagement element engages said at least one flywheel engagement member.

19. The implement of claim 18, wherein said annular recoil starter mechanism further comprises:

a spring mechanism biasing said at least one engagement element to its said retracted position.

20. The implement of claim 19, wherein said spring is connected to an annular ring member comprising said at least one engagement member.

* * * * *